US010542591B2

(12) United States Patent
Fang et al.

(10) Patent No.: US 10,542,591 B2
(45) Date of Patent: Jan. 21, 2020

(54) LED LAMP(S) WITH SINGLE CHANNEL DRIVER

(71) Applicant: SIGNIFY HOLDING B.V., Eindhoven (NL)

(72) Inventors: Yuhong Fang, Naperville, IL (US); Wilhelmus Josephus Cornelissen, Eindhoven (NL); Sreeraman Venkitasubrahmanian, Naperville (IL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/321,465

(22) PCT Filed: Jul. 12, 2017

(86) PCT No.: PCT/EP2017/067587

§ 371 (c)(1),
(2) Date: Jan. 29, 2019

(87) PCT Pub. No.: WO2018/019596

PCT Pub. Date: Feb. 1, 2018

(65) Prior Publication Data

US 2019/0166662 A1 May 30, 2019

Related U.S. Application Data

(60) Provisional application No. 62/368,515, filed on Jul. 29, 2016.

(30) Foreign Application Priority Data

Aug. 23, 2016 (EP) ..... 16185244

(51) Int. Cl.

| | |
|---|---|
| ***H05B 37/02*** | (2006.01) |
| ***H05B 33/08*** | (2006.01) |
| ***F21K 9/27*** | (2016.01) |

(52) U.S. Cl.
CPC ..... *H05B 33/0809* (2013.01); *F21K 9/27* (2016.08); *H05B 33/089* (2013.01); (Continued)

(58) Field of Classification Search
CPC ..... H05B 33/0842; H05B 33/0844
(Continued)

(56) References Cited

U.S. PATENT DOCUMENTS

2002/0140372 A1 10/2002 Langeslag et al.
2008/0297062 A1 12/2008 Otake et al.
(Continued)

FOREIGN PATENT DOCUMENTS

DE 102009028101 A1 2/2010
DE 102008037551 A1 5/2010
(Continued)

*Primary Examiner* — Thuy V Tran
(74) *Attorney, Agent, or Firm* — Daniel J. Piotrowski

(57) ABSTRACT

A light emitting diode (LED) apparatus is provided for driving a plurality of LED lamps (in parallel. The light emitting diode apparatus includes at least one LED driver circuit to provide a LED driving current for the plurality of LED lamps. The LED driver circuit includes a current setting resistance circuit for setting a maximum value of the LED driving current and a detection circuit to detect presence or absence of each of the plurality of LED lamps by detection of the current flowing through each of the LED lamps. The detection circuit adjusts the current setting resistance circuit based on the detection of presence or absence and the current setting resistance circuit includes a plurality of setting resistors and a plurality of transistors.

13 Claims, 4 Drawing Sheets

(52) U.S. Cl.
CPC ..... *H05B 33/0827* (2013.01); *H05B 33/0848* (2013.01); *H05B 33/0842* (2013.01)

(58) Field of Classification Search
USPC ..... 315/185 R, 201
See application file for complete search history.

(56) References Cited

U.S. PATENT DOCUMENTS

| | | | | |
|---|---|---|---|---|
| 2011/0057580 | A1 | 3/2011 | Notohamiprodjo et al. | |
| 2011/0210675 | A1 | 9/2011 | Hamamoto et al. | |
| 2012/0019166 | A1* | 1/2012 | Terasaka ..... | H05B 33/089 315/294 |
| 2012/0119662 | A1* | 5/2012 | Radermacher ..... | H05B 33/0851 315/158 |
| 2013/0093309 | A1 | 4/2013 | Deppe | |
| 2013/0221867 | A1 | 8/2013 | Deppe et al. | |
| 2014/0104824 | A1 | 4/2014 | Hsia et al. | |
| 2015/0195884 | A1 | 7/2015 | Angelin et al. | |

FOREIGN PATENT DOCUMENTS

| | | | |
|---|---|---|---|
| EP | 1889519 | A2 | 2/2008 |
| EP | 2814302 | A1 | 12/2014 |

* cited by examiner

LED LAMP(S) WITH SINGLE CHANNEL DRIVER

CROSS-REFERENCE TO PRIOR APPLICATIONS

This application is the U.S. National Phase application under 35 U.S.C. § 371 of International Application No. PCT/EP2017/067587, filed on Jul. 12, 2017 which claims the benefit of U.S. Provisional Patent Application No. 62/368,515, filed on Jul. 29, 2016 and European Patent Application No. 16185244.7, filed on Aug. 23, 2016. These applications are hereby incorporated by reference herein.

FIELD OF THE DISCLOSURE

The present disclosure relates to the field of light emitting diode (LED) lamps. More particularly, the present disclosure relates to LED lamp(s) with a single channel driver.

BACKGROUND INFORMATION

A typical light emitting diode driver outputs constant current for loads of one or more light emitting diodes of an LED lamp. An LED lamp may be connected to a light emitting diode driver, such as in a North American Linear troffer fixture. In a light emitting diode retrofit system, an LED lamp composed of light emitting diodes in parallel and/or series may be driven with direct current (DC) using an LED driver with DC output. Multiple LED lamps can be driven in parallel, and when any LED lamp is removed the remaining LED lamps share the total current. As an example, when three LED lamps are driven at 6 Amperes and one of the LED lamps is removed, the remaining two LED lamps still share the 6 Amperes. Increasing the current to the remaining lamp increases the light of the remaining lamp and reduces its lifetime.

With reference top US 2015/0195884, EP1889519, EP2814302, US2008/0297062, and US2011/0210675, several solution are known for setting athe current of a driver. All these solutions propose to have an additional element in the lamp for identifying on the driver side the number of connected lamp. In particular, it is possible to add a resistor inside each lamp and to have one or two specific output(s) that could be provided in parallel to corresponding input of the driver in such a way that the driver set his power as a function of the measured equivalent resistor. Such solution needs to pair the drivers and the lamp and does not enable to adapt the power of the driver when a lamp fails.

SUMMARY OF THE INVENTION

The invention provide another solution in which an additional circuit is added for sensing the current into the lamp and determining how many functional lamp are connected. Depending of the detected lamp a current setting resistance that determine the output current of the driver is adjusted in such a way that the output current of the driver is adjusted to the number of functional lamp that are connected.

According to a first aspect, the invention is a light emitting diode (LED) apparatus configured for driving a plurality of LED lamps in parallel, that comprises at least one LED driver and a detection circuit. The at least one LED driver circuit is adapted to provide a LED driving current for the plurality of LED lamps, the LED driver circuit comprising a current setting resistance circuit for setting a maximum value of the LED driving current. The detection circuit is adapted to detect presence or absence of each of the plurality of LED lamps by measurement of the current flowing through each of the LED lamps. The detection circuit is configured to adjust the current setting resistance circuit based on the detection of presence or absence.

Preferentially, the light emitting diode apparatus comprises a single LED driver circuit, and the LED apparatus may be a retrofit system with the plurality of LED lamps and the single LED driver circuit. Each present LED lamp may comprise a tubular shape. The current setting resistance circuit may comprise a plurality of setting resistors and a plurality of transistors. The current setting resistance circuit may be installed as a component of the light emitting diode apparatus. The current setting resistance circuit may include identical circuit components in an identical arrangement for each LED lamp. The current setting resistance circuit may be adapted to set the LED driving current of a LED driver circuit based on the detection of presence.

According to a second aspect, the invention is a method for driving a plurality of LED lamps of a light emitting diode apparatus, that comprises:

providing a LED driving current for the plurality of LED lamps by a LED driver circuit comprising a current setting resistance circuit used to set a maximum value of the LED driving current;

detecting presence or absence of each of the plurality of LED lamps using a detection circuit that measures the current flowing through each LED lamp, and adjusting the current setting resistance circuit based on detecting the presence or absence.

Preferentially, the current setting resistance circuit may be adjusted by switching in parallel setting resistors in response to detecting the absence of one of the light emitting diode lamps. The adjusting a LED driving current may be made using the current setting resistance circuit and additional resistors of the current setting resistance circuit comprising a plurality of resistors and a plurality of transistors. The current setting resistance circuit may be a component of the light emitting diode apparatus. The current setting resistance circuit may include identical circuit components in an identical arrangement for each LED lamp. The switching may be made by switching in one identical set of circuit components for each absent LED lamp. The switching may be made by switching out one identical set of circuit components for each absent LED lamp.

DETAILED DESCRIPTION

In view of the foregoing, the present disclosure, through one or more of its various aspects, embodiments and/or specific features or sub-components, is thus intended to bring out one or more of the advantages as specifically noted below.

The present disclosure describes an LED lamp or lamps with a single channel driver. As described herein, each LED lamp may include multiple light emitting diodes, and a single channel driver may drive one or more LED lamps that each include multiple light emitting diodes. The teachings of the present disclosure provide for a detector that detects presence or absence of light emitting diodes in an LED lamp and/or presence or absence of an LED lamp in a luminaire (apparatus) with multiple LED lamps. As a result, the present disclosure includes teachings for detecting the presence of both individual light emitting diodes as well as the presence or absence of LED lamps that include multiple light emitting diodes.

The present disclosure also provides for adjusting current or power to the remaining LED lamps and light emitting diodes based on the detection of presence or absence of the LED lamps and light emitting diodes. In this way, when a LED lamp or light emitting diode is removed for any reason, the current or power to the remaining LED lamps and light emitting diodes driven by the single channel driver can be reduced to help avoid, e.g., overheating.

Methods described herein are illustrative examples, and as such are not intended to require or imply that any particular process of any embodiment be performed in the order presented. Words such as "thereafter," "then," "next," etc. are not intended to limit the order of the processes, and these words are instead used to guide the reader through the description of the methods. Further, any reference to claim elements in the singular, for example, using the articles "a," "an" or "the", is not to be construed as limiting the element to the singular.

Additionally, terms such as "driving circuit" and "driver" may be used interchangeably herein. In the absence of explanations distinguishing such terms, similar and comparable terms such as these should be considered equivalent for the purposes of the explanations provided herein. As an example, a microcontroller described herein may also be, for example, a microprocessor chip, a controller, or a digital signal microprocessor (DSP).

Figure 1:
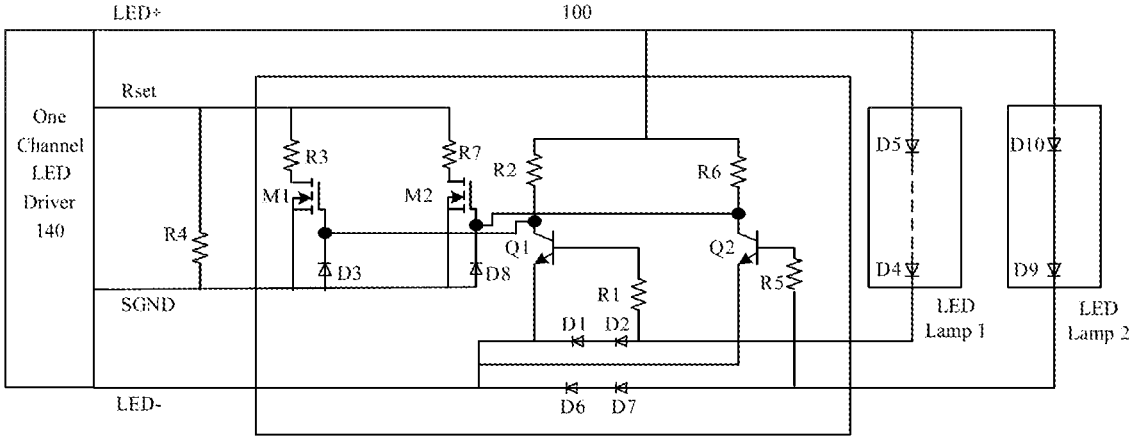
FIG. 1 shows an exemplary circuit arrangement for the LED lamp(s) with single channel driver, according to an aspect of the present disclosure.

FIG. 1 shows an exemplary circuit arrangement for the LED lamp with single channel driver, according to an aspect of the present disclosure. In FIG. 1, each LED lamp LED Lamp1 and LED Lamp2 is a product that includes one or more light emitting diodes. A circuit is added between LED lamps (LED Lamp1 and LED Lamp2) and the one channel LED driver 140. When the LED lamps LED Lamp1 and/or LED Lamp2 are removed for any reason, the added circuit will change current setting resistance (Rset), to adjust the output current of the LED driver 140 to match the lamp current appropriate for the remaining LED lamps LED Lamp1 and/or LED Lamp2.

The current setting resistance Rset has the role of setting the maximum current output of the one channel LED driver 140. The maximum current output value may be set in accordance with a standard set by a standards body. The current setting resistance Rset can be set either proportionally or inversely proportionally to the maximum current output value.

Figure 2:
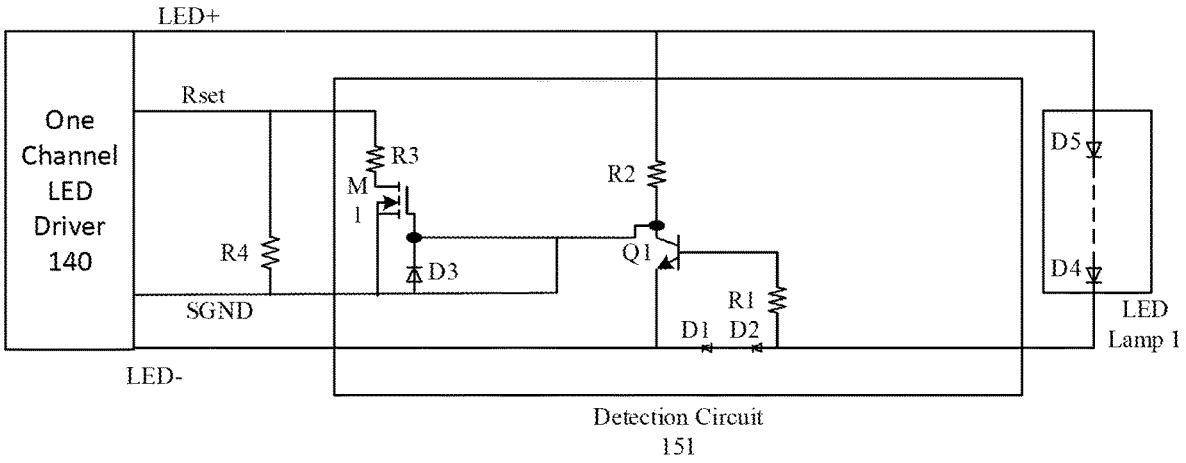
FIG. 2 shows an exemplary detection circuit isolated in the context of the circuit arrangement of FIG. 1.
Figure 3:
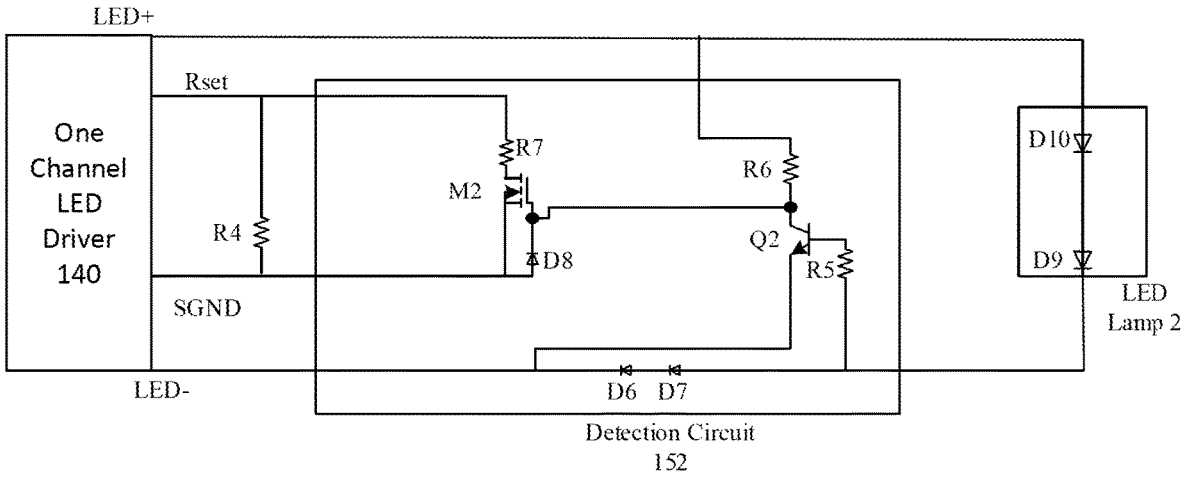
FIG. 3 shows another exemplary detection circuit isolated in the context of the circuit arrangement of FIG. 1.

In the embodiment(s) shown in FIGS. 1-3, the current setting resistance Rset is set proportional to a current output value. When current setting resistance Rset is proportional to the current output value, the total resistance is decreased in response to the detected absence of an LED lamp, which in turn sets effective output current of an LED driver smaller.

In an alternative arrangement, total resistance may be increased to compensate for the detected absence of an LED lamp, which effectively makes total resistance inversely proportional to the maximum output current. In another alternative embodiment, a resistive component or circuit may be switched out (rather than in) based upon detecting absence of an LED lamp, so as to increase total resistance. Total resistance can be increased by switching out a resistive component or circuit when the resistive element or circuit that is switched out was in parallel with the remaining resistance. That is, switchable resistive elements and circuits can be arranged in a variety of ways, each with its own set of advantages and disadvantages.

As shown with respect to FIGS. 1-3, current setting resistance Rset can be set proportional to a driver current output value by switching in a resistive component or a resistive circuit in parallel with existing resistive components or resistive circuits. In this way, a total resistance of parallel elements is made smaller than what would be the case if no resistive component or resistive circuit were switched in. This smaller total resistance sets effective output current of a driver smaller to match a remaining LED lamp(s).

The embodiments of FIGS. 1-3 could be modified to increase total resistance by switching out resistive elements or circuits in parallel with the remaining resistance. In the modified embodiment that switches elements or circuits out, inverters can be added between MOSFETs and Q gates, and the configuration of resistors is changed. This modified embodiment is explained further below.

Still further, instead of switching a resistance component or circuit in when absence of a light emitting diode lamp (LED Lamp1 or LED Lamp2) is detected, Rset may be matched with a maximum current output value and the entirety of a resistive circuit as the default for when all LED lamps are present. When absence of an LED lamp is detected, a portion of the resistance circuit may be disconnected (rather than connected) in order to maintain the maximum current. As noted above, this alternative is possible so as to either increase total resistance when the resistive element or circuit that is switched out was in parallel with the remaining resistance.

In FIG. 1, the added circuit automatically adjusts current to match the number of present LED lamps. The added circuit actually includes two identical circuits or sub-circuits, or the same number of identical circuits or sub-circuits as would match the maximum number of possible present LED lamps.

The first of the two identical circuits or sub-circuits is made up of D1, D2, R1, Q1, R2, D3, M1, and R3. The second of the two identical circuits or sub-circuits is made up of D6, D7, R5, Q2, R6, D8, M2, and R7. In FIG. 1, the disclosed embodiment is operable when, for example, R3=R4=R7.

As noted above, the embodiment of FIG. 1 can be modified to increase total resistance by switching out (rather than switching in) resistive elements or circuits in parallel with the remaining resistance. Inverted control signals for the MOSFETs M1 and M2 are produced by adding a first inverter stage between Q1 and the gate of M1, and a second inverter stage between Q2 and the gate of M2. As an example, this configuration produces a satisfactory result if R3=R7, and R4 is suppressed or set with a relatively high value in comparison.

FIGS. 2 and 3 break out separate LED lamp detection circuits from FIG. 1. As detailed in FIGS. 2 and 3, a separate LED lamp detection circuit is provided for each light emitting diode lamp in FIG. 1.

In FIG. 2, a first LED lamp detection circuit 151 for LED Lamp1 in FIG. 1 is made up of D1, D2, R1, Q1 and R2.

When LED Lamp1 is present, NPN transistor Q1 will be turned on by the voltage drop on D1 and D2 since current flows through LED Lamp1. LED- and SGND usually have the same or a very close potential. The gate voltage of M1 is low, and metal-oxide semiconductor field-effect transistor (MOSFET) M1 is off.

In FIG. 3, a second LED lamp detection circuit 152 for LED Lamp2 in FIG. 1 is made up of D6, D7, R5, Q2 and R6. When LED Lamp2 is present, NPN transistor Q2 will be turned on by the voltage drop on D6 and D7 since current flows through LED Lamp2. LED- and SGND are the same as for the first LED lamp detection circuit 151, and the gate voltage of M2 is low and MOSFET M2 is off.

In FIG. 1, when both lamps LED Lamp1 and LED Lamp2 are connected, then both MOSFETs M1 and M2 will be off, and the LED driver current is set by R4. When LED Lamp1 is absent (or off), the gate voltage of MOSFET M1 is high and M1 is turned on. The LED driver current is set by R4 and R3 in parallel. R3 is chosen to ensure the LED driver output current meets the one-lamp requirement. When LED Lamp2 is absent (or off), the gate voltage of MOSFET M2 is high and M2 is turned on. The LED driver current is set by R4 and R7 in parallel. R7 is chosen to ensure the LED driver output current meets the one-lamp requirement.

That is, in FIG. 1, the circuit(s) 151, 152, added between the LED driver and LED lamps LED Lamp1 and LED Lamp2, are used to vary the resistance based on the detected number of LED lamps among LED Lamp1 and LED Lamp2. Of course, additional circuits or sub-circuits may be added to correspond to more potential LED lamps in FIG. 1.

The variable resistance is implemented automatically. That is, based on the presence or absence of an LED lamp, the resistance to set current from the LED driver can be increased or decreased so that the effective current for the present LED lamps is appropriate based, for example, on requirements for standards set to ensure LED lamps do not overheat.

Presence of LED Lamp1 is sensed by Q1 being on, and M1 will therefore be off. However, when LED Lamp1 is absent or off, Q1 will be off, and the gate voltage on MOSFET M1 will be high so that R3 is in parallel with R4. The total resistance of R3 and R4 are smaller, and this sets effective output current of the LED driver 140 smaller to match the remaining LED lamp.

Presence of LED Lamp2 is sensed by Q2 being on, and M2 will therefore be off. However, when LED LAMP2 is absent or off, Q2 will be off, and the gate voltage on MOSFET M2 will be high so that R7 is in parallel with R4. The total resistance of R7 and R4 are smaller, and this sets effective output current of the LED driver 140 smaller to match the remaining LED lamp.

Of course, if both LED Lamp1 and LED Lamp2 are absent or off, then both R3 and R7 are brought in parallel with R4, so that the current provided to remaining LED lamps is not raised. As a result, the one channel LED driver 140 can avoid overheating the remaining LED lamps.

In FIG. 1, LED Lamp1 and LED Lamp2 each include a light emitting diode or light emitting diodes. In FIG. 1, two different specific detection circuits or sub-circuits 151, 152 are provided to detect presence of each of the two corresponding LED lamps. The first specific detection circuit includes circuit elements D1, D2, R1, Q1 and R2. The second specific detection circuit includes circuit elements D6, D7, R5, Q2 and R6. The luminaire (LED apparatus) of the overall FIG. 1 includes the one-channel LED driver 140, the two specific detection circuits, two variable resistance circuits/sub-circuits, and the two LED lamps LED Lamp1 and LED LAMP2.

As explained above, the variable resistance circuits are implemented using transistors Q1 and Q2, and MOSFETS M1 and M2. The variable resistance is provided by adding in resistors R3 and/or R7 in parallel to R4. Of course, numerous other ways exist to variably add or subtract resistance based on a detected presence of a circuit element.

In FIG. 1, a single LED driver 140 is shown. The LED driver 140 is a single channel LED driver that drives multiple different LEDs or lamps with multiple LEDs. The overall LED apparatus shown in FIG. 1 may be a retrofit system imposed on a fluorescent lighting system. LED Lamp1 and LED Lamp2 may also include features shown in other Figures such as FIGS. 1*a* and 1*b*, with extra terminals intended for support, but shorted so as to be used as switches to switch off power when any expected LED lamp is absent.

In another embodiment, the lamp detector circuits/sub-circuits and the variable resistance circuits/sub-circuits can be included as components of the one channel LED driver 140. For example, detector circuits and variable resistance circuits can be constructed with the one channel LED driver 140 at a factory or other manufacturing assembly. Furthermore, the LED lamps, whether two as shown or more, can also be constructed with the one channel LED driver 140 at a factory.

FIGS. 2 and 3 show exemplary detection circuits isolated in the context of the circuit arrangement of FIG. 1. In FIG. 2, detection circuit 151 is the first detection circuit for detecting the presence or absence of LED Lamp1. In FIG. 2, detection circuit 152 is the second detection circuit for detecting the presence or absence LED Lamp2. As described in the present disclosure, additional LED lamps and detection circuits can be provided in an apparatus with a single one channel LED driver 140, and the absence of any particular LED lamp can be compensated by invoking one of the detection circuits as a variable resistance circuit automatically using circuit components or a microcontroller.

Figure 4:
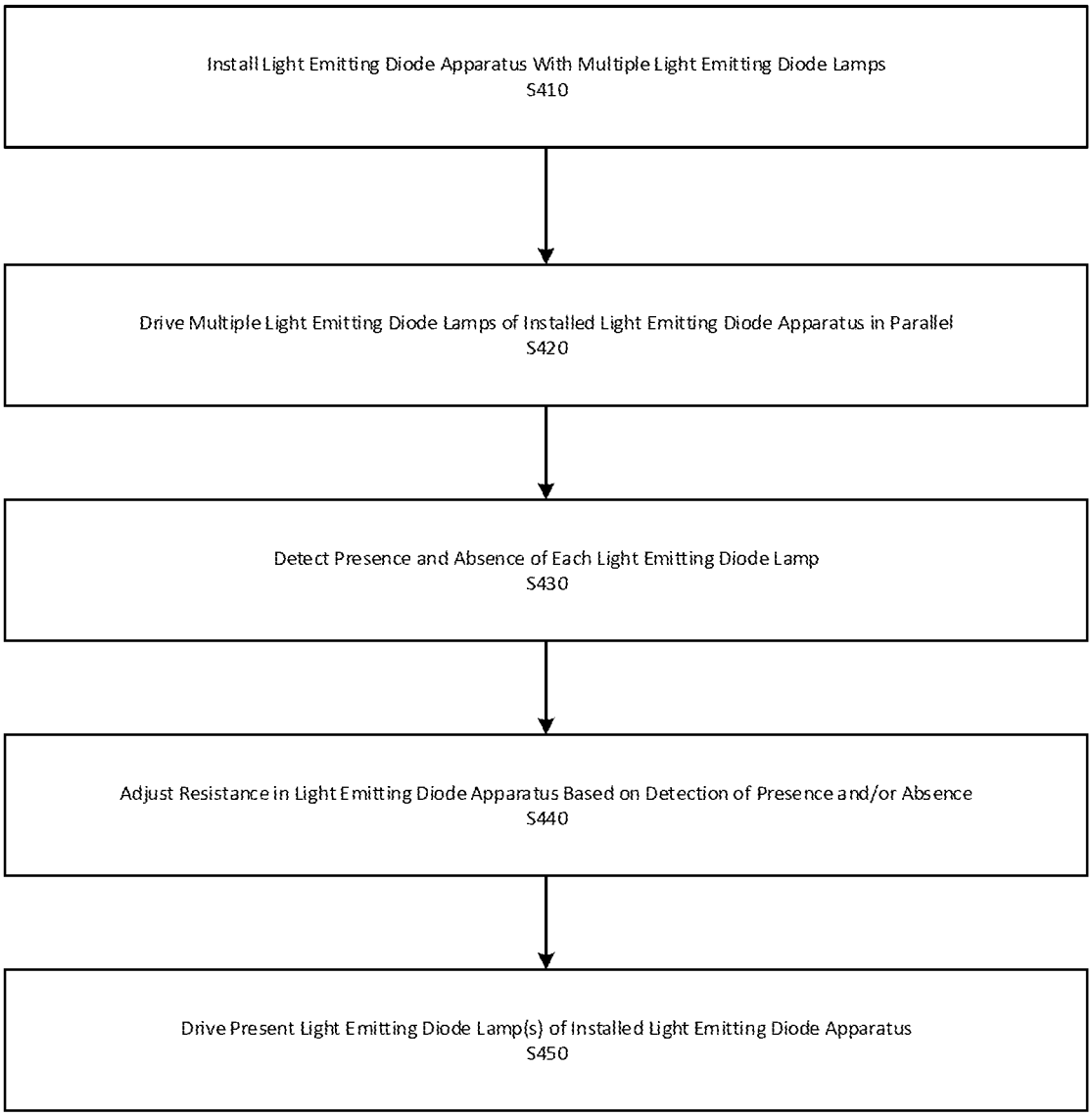
FIG. 4 shows an exemplary method for operation of an exemplary circuit arrangement for the LED lamp(s) with single channel driver, according to an aspect of the present disclosure.

FIG. 4 shows an exemplary method for operation of an exemplary circuit arrangement for the LED lamp(s) with single channel driver, according to an aspect of the present disclosure. In FIG. 4, a light emitting diode apparatus is initially installed with multiple LED lamps at S410. The light emitting diode apparatus may be configured with, for example, four LED lamps, and installed as a retrofit assembly at S410.

At S420, the multiple LED lamps are driven in parallel. At S430, the presence or absence of each LED lamp is detected using circuitry such as that explained with respect to FIGS. 1-3.

At S440, the resistance in the light emitting diode apparatus is adjusted based on the detected presence or absence of each LED lamp at S430. At S450, the remaining (present) LED lamps are driven using the adjusted resistance.

As noted herein, the resistance adjusted at S440 may be adjusted higher or lower depending on whether the total resistance is maintained proportional or inversely proportional to current. The resistance may be changed by switching in additional resistive elements or a resistive circuit in parallel. Additionally, as explained above, a default resistive circuit for when all LED lamps are present may including switchable (variable) resistive elements or sub-circuits that can be switched out (rather than in) when an LED lamp is detected to be missing.

An electronic device using the teachings herein can be incorporated as or in a particular device that in turn is in an integrated system that includes additional devices. In a particular embodiment, such an electronic device can be implemented using electronic devices that provide voice, video or data communication. Further, while a single electronic device is described, such an electronic device may be included in a "system" that includes any collection of systems or sub-systems that individually or jointly execute a set, or multiple sets, of instructions to perform one or more computer software functions.

A microprocessor as described herein is tangible and non-transitory. As used herein, the term "non-transitory" is to be interpreted not as an eternal characteristic of a state, but as a characteristic of a state that will last for a period of time. The term "non-transitory" specifically disavows fleeting characteristics such as characteristics of a particular carrier wave or signal or other forms that exist only transitorily in any place at any time. A microprocessor is an article of manufacture and/or a machine component. A microprocessor for an electronic device is configured to execute software instructions in order to perform functions as described in the various embodiments herein. A microprocessor for an electronic device may be a general purpose microprocessor or may be part of an application specific integrated circuit (ASIC). Additionally, any microprocessor described herein may include multiple microprocessors, parallel microprocessors, or both. Multiple microprocessors may be included in, or coupled to, a single device or multiple devices.

Although a single channel driver for multiple LED lamps has been described with reference to several exemplary embodiments, it is understood that the words that have been used are words of description and illustration, rather than words of limitation. Changes may be made within the purview of the appended claims, as presently stated and as amended, without departing from the scope and spirit of the LED lamp with single channel driver in its aspects. Although the LED lamp with single channel driver has been described with reference to particular means, materials and embodiments, the LED lamp with single channel driver is not intended to be limited to the particulars disclosed; rather the LED lamp with single channel driver extends to all functionally equivalent structures, methods, and uses such as are within the scope of the appended claims.

For example, as described above, in FIG. 1 resistance is automatically switched in and out using transistors to sense presence of LED lamps. However, a resistive sub-circuit can be controlled logically using a switch and a microprocessor, so that resistance can be varied when LED lamps are absent.

Although the present specification describes components and functions that may be implemented in particular embodiments with reference to particular standards and protocols, the disclosure is not limited to such standards and protocols. Such standards are periodically superseded by more efficient equivalents having essentially the same functions. Accordingly, replacement standards and protocols having the same or similar functions are considered equivalents thereof.

The illustrations of the embodiments described herein are intended to provide a general understanding of the structure of the various embodiments. The illustrations are not intended to serve as a complete description of all of the elements and features of the disclosure described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

According to an aspect of the present disclosure, a light emitting diode (LED) apparatus is configured for driving light emitting diode lamps in parallel. The apparatus includes at least one driver circuit that provides a current for the light emitting diode lamps. The driver circuit includes a resistor for setting a maximum value of the current. The apparatus also includes a circuit that detects presence or absence of each of the light emitting diode lamps. The circuit is configured to adjust the resistor based on the detection of presence or absence.

According to another aspect of the present disclosure, the apparatus also includes a single light emitting diode driver, and the apparatus is a retrofit system with the light emitting diodes and the single light emitting diode driver.

According to aspect of the present disclosure, each present light emitting diode lamp comprises a tubular shape.

According to yet another aspect of the present disclosure, the driver adjusts light emitting diode driver current to match an LED lamp current rating using a current setting resistance circuit that includes multiple resistors and transistors.

According to another aspect of the present disclosure, the current setting resistance circuit is externally installed on the light emitting diode apparatus.

According to still another aspect of the present disclosure, the current setting resistance circuit includes identical circuit components in an identical arrangement for each LED lamp.

According to yet another aspect of the present disclosure, the apparatus includes a current setting circuit that sets an output current of a light emitting diode driver circuit based on the detection of presence.

According to an aspect of the present disclosure, a method for driving multiple light emitting diode lamps of a light emitting diode apparatus includes providing a current for the light emitting diode lamps by a driver circuit comprising a resistor used to set a maximum value of the current. The method includes detecting presence or absence of each of the plurality of light emitting diode lamps using a detection circuit. The method also includes adjusting the resistor based on detecting the presence or absence.

According to another aspect of the present disclosure, the light emitting diode lamps are in a retrofit system with a single light emitting diode driver.

According to still another aspect of the present disclosure, the resistor is adjusted by switching in parallel resistance in response to detecting the absence of one of the light emitting diode lamps.

According to yet another aspect of the present disclosure, the method further includes adjusting a light emitting diode driver current to match a light emitting diode current rating using the resistor and additional resistors of a current setting resistance circuit comprising multiple resistors and multiple transistors.

According to another aspect of the present disclosure, the current setting resistance circuit is a component of the light emitting diode apparatus.

According to still another aspect of the present disclosure, the current setting resistance circuit includes identical circuit components in an identical arrangement for each light emitting diode lamp.

According to yet another aspect of the present disclosure, the method includes switching in one identical set of circuit components for each absent light emitting diode lamp.

According to another aspect of the present disclosure, the method includes switching out one identical set of circuit components for each absent light emitting diode lamp. As described above, in a configuration in which multiple light emitting diode lamps (e.g., tubular LEDs) are driven in parallel normally, when any light emitting diode lamp is removed for any reason, the teachings of the present disclosure can be used to sense and turn off or adjust the current to the remaining light emitting diode lamps. The adjustments can be made using a resistive circuit that can be switched in and out based on the sensing of presence of remaining light emitting diode lamps. As a result, temperatures can be prevented from rising to levels outside of safety standards, and the life of the light emitting diode lamps can be extended.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The preceding description of the disclosed embodiments is provided to enable any person skilled in the art to make or use the present disclosure. As such, the above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

The invention claimed is:

1. A light emitting diode (LED) apparatus configured for driving a plurality of LED lamps (Lamp 1, Lamp 2) in parallel, characterized in that it comprises:

at least one LED driver circuit that is adapted to provide a LED driving current for the plurality of LED lamps, the LED driver circuit comprising a current setting resistance circuit for setting a maximum value of the LED driving current; and a detection circuit that is adapted to detect presence or absence of each of the plurality of LED lamps by detection of the current flowing through each of the LED lamps, wherein, the detection circuit is configured to adjust the current setting resistance circuit based on the detection of presence or absence; and wherein the current setting resistance circuit comprises a plurality of setting resistors and a plurality of transistors.

2. The light emitting diode apparatus of claim 1, further comprising:

a single LED driver circuit, wherein the LED apparatus is a retrofit system with the plurality of LED lamps and the single LED driver circuit.

3. The light emitting diode apparatus of claim 1, wherein each present LED lamp comprises a tubular shape.

4. The light emitting diode apparatus of claim 1, wherein the current setting resistance circuit is installed as a component of the light emitting diode apparatus.

5. The light emitting diode apparatus of claim 1, wherein the current setting resistance circuit includes identical circuit components in an identical arrangement for each LED lamp.

6. The light emitting diode apparatus of claim 1, wherein the current setting resistance circuit that is adapted to set the LED driving current of the LED driver circuit based on the detection of presence.

7. A method for driving a plurality of LED lamps of a light emitting diode apparatus, characterized in that it comprises:

providing a LED driving current for the plurality of LED lamps by a LED driver circuit comprising a current setting resistance circuit used to set a maximum value of the LED driving current;

detecting presence or absence of each of the plurality of LED lamps using a detection circuit that detects the current flowing through each LED lamp, and adjusting the current setting resistance circuit based on detecting the presence or absence; and wherein the current setting resistance circuit is adjusted by switching in parallel setting resistors in response to detecting the absence of one of the light emitting diode lamps.

8. The method for driving a plurality of LED lamps of claim 7, wherein the LED lamps are in a retrofit system with a single LED driver circuit.

9. The method for driving a plurality of LED lamps of claim 7, wherein current setting resistance circuit includes a plurality of resistors and a plurality of transistors.

10. The method for driving a plurality of LED lamps of claim 9, wherein the current setting resistance circuit is a component of the light emitting diode apparatus.

11. The method for driving a plurality of LED lamps of claim 9, wherein the current setting resistance circuit includes identical circuit components in an identical arrangement for each LED lamp.

12. The method for driving a plurality of LED lamps of claim 11, further comprising:

switching in one identical set of circuit components for each absent LED lamp.

13. The method for driving a plurality of LED lamps of claim 11, further comprising:

switching out one identical set of circuit components for each absent LED lamp.

* * * * *